US010181293B2

(12) United States Patent
Na et al.

(10) Patent No.: US 10,181,293 B2
(45) Date of Patent: Jan. 15, 2019

(54) DISPLAY APPARATUS AND METHOD FOR DRIVING THE SAME

(71) Applicant: SAMSUNG DISPLAY CO., LTD., Yongin-si, Gyeonggi-do (KR)

(72) Inventors: Hoe-seok Na, Gwangmyeong-si (KR); Jaewan Park, Seoul (KR); Mun-san Park, Hwaseong-si (KR); Jang-hyun Yeo, Seoul (KR); Jinho Park, Suwon-si (KR); Bonghyun You, Seongnam-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 314 days.

(21) Appl. No.: 15/153,493

(22) Filed: May 12, 2016

(65) Prior Publication Data

US 2017/0018234 A1 Jan. 19, 2017

(30) Foreign Application Priority Data

Jul. 15, 2015 (KR) ..... 10-2015-0100585

(51) Int. Cl.

| | |
|---|---|
| ***G09G 3/34*** | (2006.01) |
| ***G09G 3/20*** | (2006.01) |
| ***G09G 3/36*** | (2006.01) |

(52) U.S. Cl.

CPC ..... *G09G 3/3406* (2013.01); *G09G 3/3611* (2013.01); *G09G 2320/0247* (2013.01); *G09G 2320/064* (2013.01); *G09G 2320/0613* (2013.01); *G09G 2320/103* (2013.01); *G09G 2330/021* (2013.01); *G09G 2340/0435* (2013.01)

(58) Field of Classification Search

CPC combination set(s) only.
See application file for complete search history.

(56) References Cited

U.S. PATENT DOCUMENTS

2007/0279375 A1* 12/2007 Ploquin ..... G09G 3/3406 345/102
2009/0295706 A1* 12/2009 Feng ..... G09G 3/342 345/102

(Continued)

FOREIGN PATENT DOCUMENTS

JP 2008-134291 A 6/2008
JP 2008-139753 A 6/2008

(Continued)

*Primary Examiner* — Jennifer Mehmood
*Assistant Examiner* — Deeprose Subedi
(74) *Attorney, Agent, or Firm* — Lewis Roca Rothgerber Christie LLP

(57) ABSTRACT

A display apparatus includes: a backlight to generate light; a display panel to display an image by utilizing the light; a driving part to provide image signals corresponding to the image to the display panel; and a timing controller to drive the backlight, to drive the driving part at a first frequency when the image is a moving image, and to drive the driving part at a second frequency lower than the first frequency when the image is a still image. The timing controller is to set the second frequency based on a value obtained by applying a reduction rate of a flicker index corresponding to a dimming index of the backlight to a flicker index of image signals of a previous frame.

21 Claims, 6 Drawing Sheets

(56) References Cited

U.S. PATENT DOCUMENTS

| | | | | |
|---|---|---|---|---|
| 2012/0147291 | A1* | 6/2012 | Seo | G09G 3/342 349/62 |
| 2012/0154462 | A1* | 6/2012 | Hempson | G09G 3/342 345/691 |
| 2013/0021386 | A1* | 1/2013 | Min | G09G 3/34 345/690 |

FOREIGN PATENT DOCUMENTS

| | | | |
|---|---|---|---|
| JP | 2009-81762 | A | 4/2009 |
| KR | 10-2014-0025740 | A | 3/2014 |
| KR | 10-2014-0144539 | A | 12/2014 |

* cited by examiner

DISPLAY APPARATUS AND METHOD FOR DRIVING THE SAME

CROSS-REFERENCE TO RELATED APPLICATIONS

This U.S. non-provisional patent application claims priority to and the benefit of Korean Patent Application No. 10-2015-0100585, filed on Jul. 15, 2015, under 35 U.S.C. § 119, the entire content of which is hereby incorporated by reference.

BACKGROUND

1. Field

One or more aspects of example embodiments of the present invention relate to a display apparatus and a method for driving the same.

2. Description of the Related Art

In general, a display apparatus receives image signals from a system board and displays the image signals. The image signals include image signals that are updated during every frame to display a moving image (e.g., a motion picture), and image signals that are the same as those of a previous image to display a still image.

When the moving image in which images are updated during every frame is displayed, the display apparatus may be driven at a normal frequency. When the still image in which images are not updated is displayed, the display apparatus may be driven at a low frequency lower than that of the normal frequency.

However, when the display apparatus is driven at the low frequency, the possibility of recognizing a flicker may increase. As a result, when the image is displayed on the display apparatus that is driven at the low frequency, a user may recognize the flicker.

The above information disclosed in this Background section is for enhancement of understanding of the background of the present invention, and therefore, it may contain information that does not constitute prior art.

SUMMARY

One or more aspects of example embodiments of the present invention are directed toward a display apparatus that is capable of preventing or reducing a flicker phenomenon and reducing power consumption, and a method for driving the same.

According to an embodiment of the present invention, a display apparatus includes: a backlight configured to generate light; a display panel configured to display an image by utilizing the light; a driving part configured to provide image signals corresponding to the image to the display panel; and a timing controller configured to drive the backlight, to drive the driving part at a first frequency when the image is a moving image, and to drive the driving part at a second frequency lower than the first frequency when the image is a still image, the timing controller being configured to set the second frequency based on a value obtained by applying a reduction rate of a flicker index corresponding to a dimming index of the backlight to a flicker index of image signals of a previous frame.

In an embodiment, the timing controller may include: a first frequency selector configured to output a first clock signal having the first frequency; a second frequency selector configured to output a second clock signal having the second frequency; a data outputter configured to receive the image signals, to synchronize the image signals with the first clock signal, and to output the synchronized image signals to the driving part when the image of a current frame is the moving image; and a frame memory configured to store the image signals, wherein the data outputter may be configured to synchronize the image signals of the previous frame that may be provided from the frame memory with the second clock signal, and to output the synchronized image signals to the driving part, when the image of the current frame is the still image.

In an embodiment, the second frequency selector may be configured to output the second clock signal having the second frequency based on a value obtained by applying the reduction rate of the flicker index to flicker indexes of the image signals of the previous frame.

In an embodiment, the second frequency selector may include: a segment divider configured to group the image signals of the previous frame that are provided from the frame memory into a plurality of segment blocks; a first operator configured to calculate flicker indexes of the segment blocks; a second operator configured to multiply the flicker indexes of the segment blocks by the reduction rate of the flicker index; a frequency calculator configured to determine a second frequency value corresponding to a flicker index having a largest value from among the flicker indexes of the segment blocks multiplied by the reduction rate of the flicker index; and a second clock signal generator configured to generate the second clock signal having the second frequency value.

In an embodiment, each of the segment blocks may include image signals corresponding to a minimum number of pixels by which a flicker is recognizable by a user.

In an embodiment, the first operator may include a first look-up table configured to store flicker indexes corresponding to gray levels according to a reference frequency.

In an embodiment, the first operator may be configured to determine the flicker indexes respectively corresponding to the gray levels of the image signals of each of the segment blocks by utilizing the first look-up table, and to calculate a mean value of the flicker indexes of the image signals of each of the segment blocks to output the mean value as the flicker index of each of the segment blocks.

In an embodiment, the reference frequency may be a minimum value of the second frequency.

In an embodiment, the second frequency may be less than about 60 Hz and greater than about 10 Hz.

In an embodiment, the second operator may include a second look-up table configured to store the reduction rate of the flicker indexes corresponding to gray levels according to each of a plurality of dimming indexes corresponding to a reference frequency that is a minimum value of the second frequency.

In an embodiment, the second operator may be configured to determine the reduction rate of the flicker index by utilizing the second look-up table, and to multiply the flicker indexes of the segment blocks by the reduction rate of the flicker index to output a resultant value.

In an embodiment, the frequency calculator may include a third look-up table configured to store the second frequency values as a minimum frequency at which the flicker is not recognizable and corresponding to various flicker indexes.

In an embodiment, the frequency calculator may be configured to determine the second frequency value corresponding to the flicker index having the largest value among the flicker indexes of the segment blocks multiplied by the reduction rate of the flicker index by utilizing the third look up table.

According to an embodiment of the present invention, a method for driving a display apparatus includes: determining whether image signals are for a still image or for a moving image; driving a display panel at a first frequency to display the moving image when the image signals are for the moving image; grouping image signals of a previous frame into a plurality of segment blocks when the image signals are for the still image; calculating flicker indexes of the segment blocks; multiplying the flicker indexes of the segment blocks by a reduction rate of a flicker index corresponding to a dimming index of a backlight; setting a second frequency at which a flicker is not recognizable based on a flicker index having a largest value from among the flicker indexes multiplied by the reduction rate of the flicker index; and driving the display panel at the second frequency to display the still image.

In an embodiment, the driving of the display panel at the first frequency may include providing the image signals synchronized with a first clock signal having the first frequency to the display panel to display the moving image.

In an embodiment, each of the segment blocks may include image signals corresponding to a minimum number of pixels by which the flicker is recognizable by a user.

In an embodiment, the calculating of the flicker indexes may include: determining flicker indexes respectively corresponding to gray levels of the image signals of each of the segment blocks by utilizing a first look-up table storing flicker indexes according to the gray levels corresponding to a reference frequency; and calculating a mean value of the flicker indexes of the image signals of each of the segment blocks to output the mean value as the flicker index of each of the segment blocks.

In an embodiment, the reference frequency may be a minimum value of the second frequency, and the second frequency may be less than about 60 Hz and greater than about 10 Hz.

In an embodiment, the multiplying of the reduction rate of the flicker index may include: determining the reduction rate of the flicker index by utilizing a second look-up table storing the reduction rate of the flicker indexes corresponding to gray levels according to each of a plurality of dimming indexes corresponding to the reference frequency; and multiplying the flicker indexes of the segment blocks by the reduction rate of the flicker index to output a resultant value.

In an embodiment, the setting of the second frequency may include: determining a second frequency value corresponding to the flicker index having a largest value from among the flicker indexes of the segment blocks multiplied by the reduction rate of the flicker index by utilizing a third look-up table storing second frequency values as a minimum frequency at which the flicker is not recognizable and corresponding to various flicker indexes; generating a second clock signal having the determined second frequency value; and providing the display panel with image signals synchronized with the second clock signal to display the still image.

BRIEF DESCRIPTION OF THE DRAWINGS

The above and other aspects and features of the present invention will become readily apparent by reference to the following detailed description when considered in conjunction with the accompanying drawings wherein.

DETAILED DESCRIPTION

Figure 1:
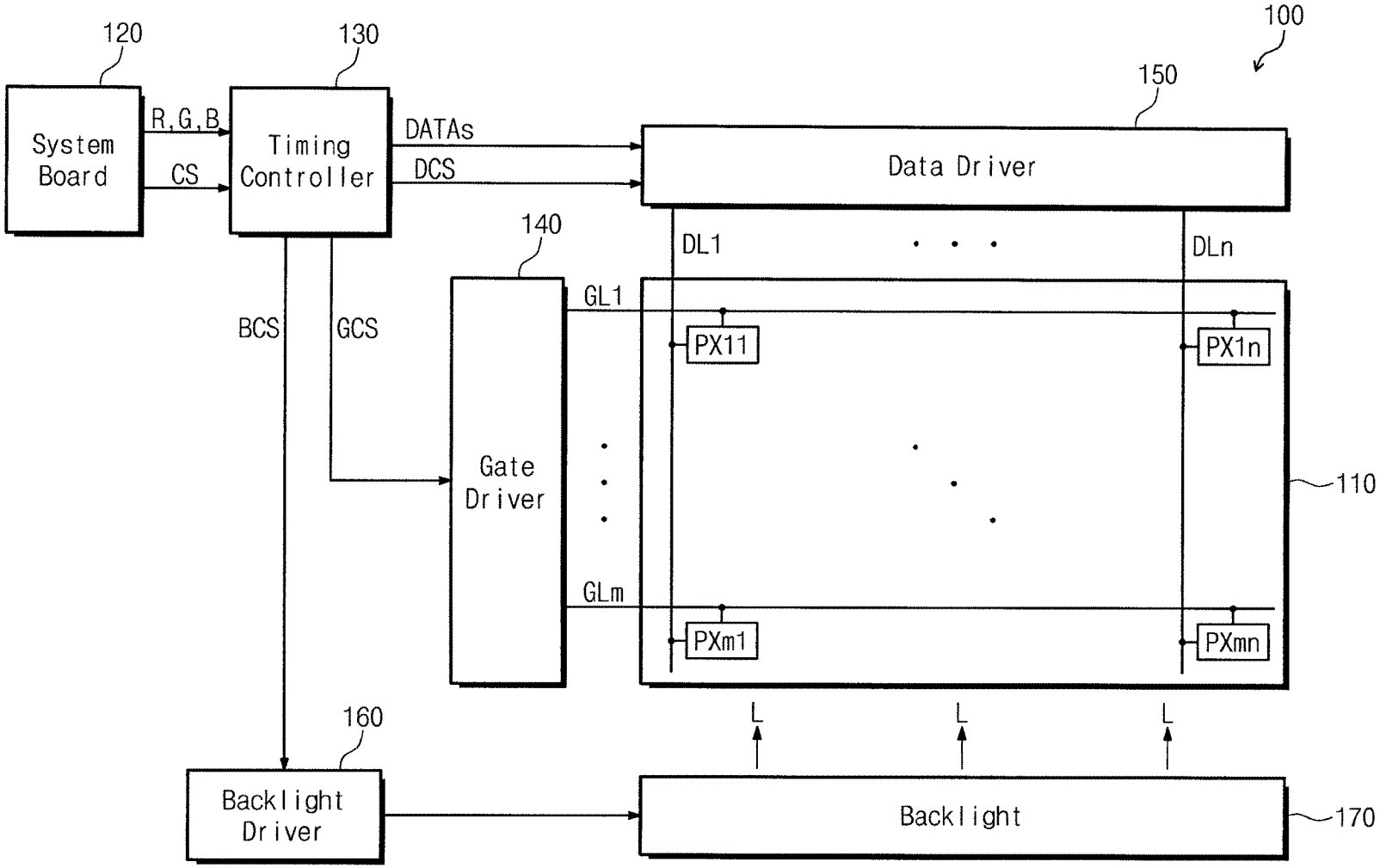
FIG. 1 is a block diagram of a display apparatus according to an embodiment of the present invention.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof may not be repeated.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

The example embodiments of the present invention will be described with schematic cross-sectional views and/or plan views as exemplary views of the present invention. Accordingly, shapes of the exemplary views may be variously modified according to manufacturing techniques and/or allowable errors. Therefore, the embodiments of the present invention are not limited to the specific shapes illustrated in the exemplary views, but may include other suitable shapes that may be created according to manufacturing processes. Areas exemplified in the drawings have general properties, and are used to illustrate an example shape of a semiconductor package region. Thus, this should not be construed as limiting the spirit and scope of the present invention.

Hereinafter, exemplary embodiments of the present invention will be described below in more detail with reference to the accompanying drawings.

FIG. 1 is a block diagram of a display apparatus according to an embodiment of the present invention.

Referring to FIG. 1, a display apparatus 100 according to an embodiment of the present invention includes a display panel 110, a system board 120, a timing controller 130, a gate driver 140, a data driver 150, a backlight driver 160, and a backlight 170.

The display panel 100 may be a liquid crystal display panel including two substrates facing each other, and a liquid crystal layer therebetween. The display panel 110 includes a plurality of gate lines GL1 to GLm, a plurality of data lines DL1 to DLn, and a plurality of pixels PX11 to PXmn. Here, m and n are natural numbers.

The gate lines GL1 to GLm extend in a row direction, and are connected to the gate driver 140. The data lines DL1 to DLn extend in a column direction crossing the row direction, and are connected to the data driver 150.

The pixels PX11 to PXmn are located at crossing areas of the gate lines GL1 to GLm and the data lines DL1 to DLn. Thus, the pixels PX11 to PXmn may be arranged in a matrix form. The pixels PX11 to PXmn are connected to the gate lines GL1 to GLm and the data lines DL1 to DLn.

Each of the pixels PX11 to PXmn may display one of primary colors. The primary colors may include red, green, blue, and white colors. However, the present invention is not limited thereto. For example, the primary colors may further include various colors, such as, yellow, cyan, and/or magenta colors.

The system board 120 provides image signals R, G, and B, and control signals CS to the timing controller 130. The image signals R, G, and B are provided to the timing controller 130 on a per-frame basis. The control signal CS may include a horizontal synchronization signal (H_SYNC), a vertical synchronization signal (V_SYNC), a main clock signal (MCLK), a data enable signal DE, and/or the like.

The system board 120 compares the image signals R, G, and B of previous and current frames. When the image signals R, G, and B of the previous and current frames are the same or substantially the same as each other, the system board 120 does not provide the image signals R, G, and B of the current frame to the timing controller 130. That is, when the image signals R, G, and B of the current frame are the image signals for displaying the still image, the system board 120 does not provide the image signals R, G, and B to the timing controller 130.

When the image signals R, G, and B of the previous and current frames are different from each other, the system board 120 provides the image signals R, G, and B of the current frame to the timing controller 130. That is, when the image signals R, G, and B of the current frame are the image signals for displaying the moving image (e.g., a motion picture), the system board 120 provides the image signals R, G, and B to the timing controller 130.

The control signal CS includes an information signal indicating whether the image signals of the current frame are image signals for the still images or for the moving images. That is, the system board 120 notifies to the timing controller 130 whether the image signals of the current frame are for the still images or for the moving images through the control signal CS.

The timing controller 130 receives the image signals R, G, and B and the control signal CS from the system board 120. The timing controller 130 converts a data format of the image signals R, G, and B, so that the image signals R, G, and B meet interface specifications of the data driver 150. The timing controller 130 provides image data DATAs of which the data format is converted to the data driver 150.

The timing controller 130 generates a gate control signal GCS, a data control signal DCS, and a backlight control signal BCS in response to the control signal CS. The gate control signal GCS is a control signal for controlling an operation timing of the gate driver 140. The data control signal DCS is a control signal for controlling an operation timing of the data driver 150.

The timing controller 130 analyzes the image signals R, G, and B to generate the backlight control signal BCS. The backlight control signal BCS is a control signal for driving the backlight 170 based on a dimming method. A driving technique based on the dimming method is used to control an amount of light of the backlight 170 corresponding to (e.g., in consideration of) luminance of an image to reduce power consumption.

For example, in the case of the image signals R, G, and B for displaying a dark image, the timing controller 130 generates the backlight control signal BCS to lower the luminance of light L that is generated from the backlight 170. In the case of the image signals R, G, and B for displaying a bright image, the timing controller 130 generates the backlight control signal BCS to increase the luminance of light L that is generated from the backlight 170.

When the display panel 110 displays the moving image in which the image is updated during every frame, the timing controller 130 drives the display panel 110 at a first frequency. When the display panel 110 displays the still image in which the image is not updated, the timing controller 130 drives the display panel 110 at a second frequency lower than the first frequency.

For example, the gate driver 140 and the data driver 150 may be referred to as a driving part configured to drive the display panel 110 by control of the timing controller. When the display panel 110 displays the moving image, the timing controller 130 may drive the driving part at the first frequency. When the display panel 110 displays the still image, the timing controller 130 may drive the driving part at the second frequency. The driving part may be driven according to the first or second frequency to drive the display panel 110 to display the image.

When the timing controller 130 receives the information signal indicating that the image signals of the current frame are for the moving image from the system board 120, the timing controller 130 outputs the image data DATAs corresponding to the first frequency.

When the timing controller 130 receives an information signal indicating that the image signals of the current frame are for the still image from the system board 120, the timing controller 130 outputs the image data DATAs corresponding to the second frequency. The image data DATAs outputted corresponding to the second frequency are the image data DATAs of the previous frame that are stored in a frame memory of the timing controller 130.

The timing controller 130 may set the second frequency in consideration of the dimming index of the backlight 170 and the flicker indexes of the image signals R, G, and B, to determine the desired (e.g., optimized) second frequency. For example, the timing controller 130 may set the second frequency according to a value obtained by applying a reduction rate of the flicker index corresponding to the dimming index of the backlight 170 to the flicker indexes of the image signals of the previous frame. This operation will be described in more detail later with reference to FIG. 3.

The timing controller 130 provides the gate control signal GCS to the gate driver 140, and provides the data control signal DCS to the data driver 150. The timing controller 130 provides the backlight control signal BCS to the backlight driver 160.

The gate driver 140 generates gate signals in response to the gate control signal GCS. The gate signals may be outputted sequentially. That is, the gate signals are provided to the pixels PX11 to PXmn on a per-row basis through the gate lines GL1 to GLm.

The data driver 150 generates data voltages (e.g., analog data voltages) corresponding to the image data DATAs, in response to the data control signal DCS. The data voltages are provided to the pixels PX11 to PXmn through the data lines DL1 to DLn.

The gate driver 140 and the data driver 150 may be formed of a plurality of driving chips that are mounted on a flexible printed circuit board, and connected to the display panel 110 in a tape carrier package (TCP) method. However, the present invention is not limited thereto. For example, the gate driver 140 and the data driver 150 may be formed of the plurality of driving chips and mounted on the display panel 110 in a chip on glass (COG) method. Alternatively, the gate driver 140 may be formed concurrently (e.g., simultaneously) with transistors of the pixels PX11 to PXmn, and may be mounted on the display panel 110 in an amorphous silicon TFT gate driver circuit (ASG).

The backlight driver 160 drives the backlight 170 based on the dimming method, so that the backlight 170 generates the light L having a luminance (e.g., a predetermined luminance), in response to the backlight control signal BCS. The backlight 170 may be located at a rear side of the display panel 110. The backlight 170 may include emission diodes for generating the light L and/or a cold cathode fluorescent lamp. The light L generated from the backlight 170 is provided to the display panel 110.

The display panel 110 displays the image by using the light L provided from the backlight 170. For example, the pixels PX11 to PXmn receive the data voltages through the data lines DL1 to DLn in response to gate signals provided through the gate lines GL1 to GLm. The pixels PX11 to PXmn may display a gradation (e.g., gray levels) corresponding to the data voltages to display the image. The pixels PX11 to PXmn that are driven by the data voltages may adjust a transmittance of light provided from the backlight 170 to display the image.

Figure 2:
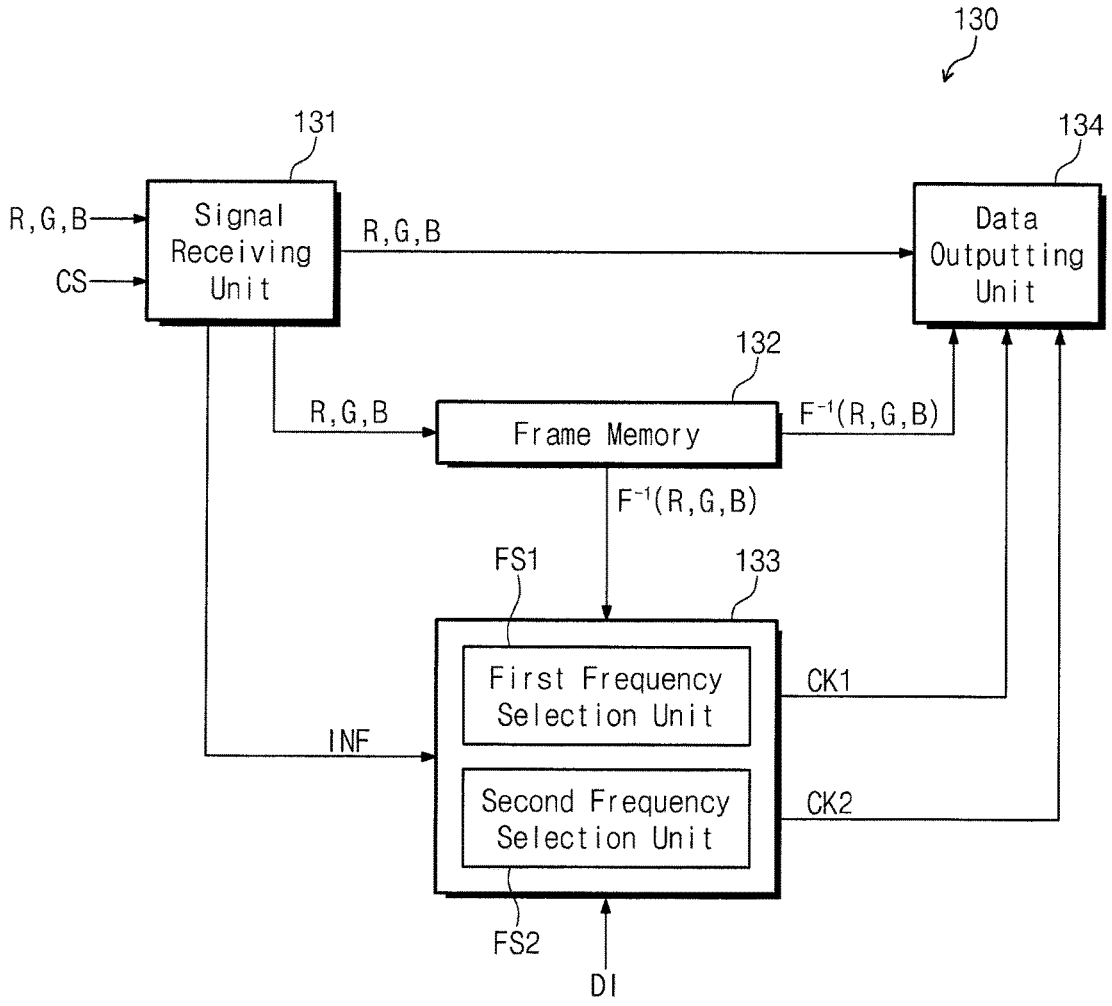
FIG. 2 is a schematic view illustrating a block diagram of a timing controller of FIG. 1.

FIG. 2 is a schematic view illustrating a block diagram of the timing controller of FIG. 1;

Referring to FIG. 2, the timing controller 130 includes a signal receiving unit (e.g., a signal receiver) 131, a frame memory 132, a frequency setting unit (e.g., a frequency setter) 133, and a data outputting unit (e.g., a data outputter) 134.

The signal receiving unit 131 receives the image signals R, G, and B and the control signal CS. The control signal CS includes an information signal INF for indicating whether the image signals of the current frame are for the still images or for the moving images.

When the information signal INF corresponds to the moving image, the signal receiving unit 131 provides the image signals R, G, and B to the data outputting unit 134. Also, the signal receiving unit 131 provides the image signals R, G, and B to the frame memory 132. The image signals R, G, and B are stored in the frame memory 132. When the information signal INF corresponds to the still image, the signal receiving unit 131 does not receive the image signals R, G, and B. For example, when the system board 120 determines that the image signals R, G, and B are for the still image, the system board 120 may not transmit the image signals R, G, and B for the still image to the signal receiving unit 131.

The signal receiving unit 131 provides the information signal INF of the control signal CS to the frequency setting unit 133. When the information signal INF corresponds to the moving image, the frequency setting unit 133 outputs a first clock signal CK1 having the first frequency. For example, the first frequency may be set to about 60 Hz.

When the information signal INF corresponds to the still image, the frequency setting unit 133 outputs a second clock signal CK2 having the second frequency. For example, the second frequency may be set to a frequency that is less than about 60 Hz and greater than or equal to about 10 Hz.

The frequency setting unit 133 includes a first frequency selection unit (e.g., a first frequency selector) FS1 that is activated in response to the information signal INF corresponding to the moving image, and a second frequency selection unit (e.g., a second frequency selector) FS2 that is activated in response to the information signal INF corresponding to the still image. The activated first frequency setting unit FS1 outputs the first clock signal CK1 having the first frequency. The first clock signal CK1 is provided to the data outputting unit 134.

The backlight control signal BCS includes a dimming index DI of the backlight 170. The dimming index DI refers to a dimming value that is defined as a driving rate of the backlight. For example, as the luminance of the backlight increases, the driving rate of the backlight increases, and thus, the dimming index increases. As the luminance of the backlight decreases, the driving rate of the backlight decreases, and thus, the dimming index decreases.

The dimming index DI is provided to the second frequency selection unit FS2 of the frequency setting unit 133. The activated second frequency selection unit FS2 receives the image signals $F^{-1}$(R, G, B) of the previous frame from the frame memory 132 and the dimming index DI to output the second clock signal CK2 having the second frequency. The second clock signal CK2 is provided to the data outputting unit 134.

For example, the activated second frequency selection unit FS2 calculates the flicker indexes of the image signals $F^{-1}$(R, G, B) of the previous frame. The second frequency selection unit FS2 outputs the second clock signal CK2 having the second frequency according to a value obtained by applying the reduction rate of the flicker index corresponding to the dimming index DI to the calculated flicker indexes. The second frequency is set to a frequency (e.g., a minimum frequency) at which the flicker phenomenon is not generated. This operation will be described below in more detail with reference to FIG. 3.

The data outputting unit 134 converts the image signals R, G, and B that are received from the signal receiving unit 131 to the image data DATAs. When the information signal INF corresponds to the moving image, the data outputting unit 134 synchronizes the signal with the first clock signal CK1 having the first frequency to output the image data DATAs.

When the information signal INF corresponds to the still image, the image signals R, G, and B are not provided to the signal receiving unit 131, and the image signals $F^{-1}$(R, G, and B) of the previous frame that is stored in the frame memory 132 are provided to the data outputting unit 134. The data outputting unit 134 converts the image signals $F^{-1}$(R, G, and B) of the previous frame that are provided from the frame memory 132 to the image data DATAs, and synchronizes the converted image data with the second clock signal CK2 having the second frequency to output the image data DATAs.

The image data DATAs are provided to the data driver 150 according to the first or second frequency, and the data driver 150 converts the image data DATAs to the data voltages, and provides the converted data voltages to the display panel 110.

The display panel 110 receives the data voltages according to the first or second frequency. Thus, the display panel 110 is driven at the first frequency when the information signal INF corresponds to the moving image, and the display panel 110 is driven at the second frequency when the information signal INF corresponds to the still image.

Although the data outputting unit 134 converts the image signals R, G, and B to the image data DATAs according to an embodiment of the present invention, the present invention is not limited thereto. For example, a driving block to convert the image signals R, G, and B to the image data DATAs may be located at the outside of the data outputting unit 134.

The timing controller 130 may further include a control signal generation unit (e.g., a control signal generator) configured to generate the gate control signal GCS, the data control signal DCS, and the backlight control signal BCS using the control signal CS that is provided thereto from the signal receiving unit 131.

Figure 3:
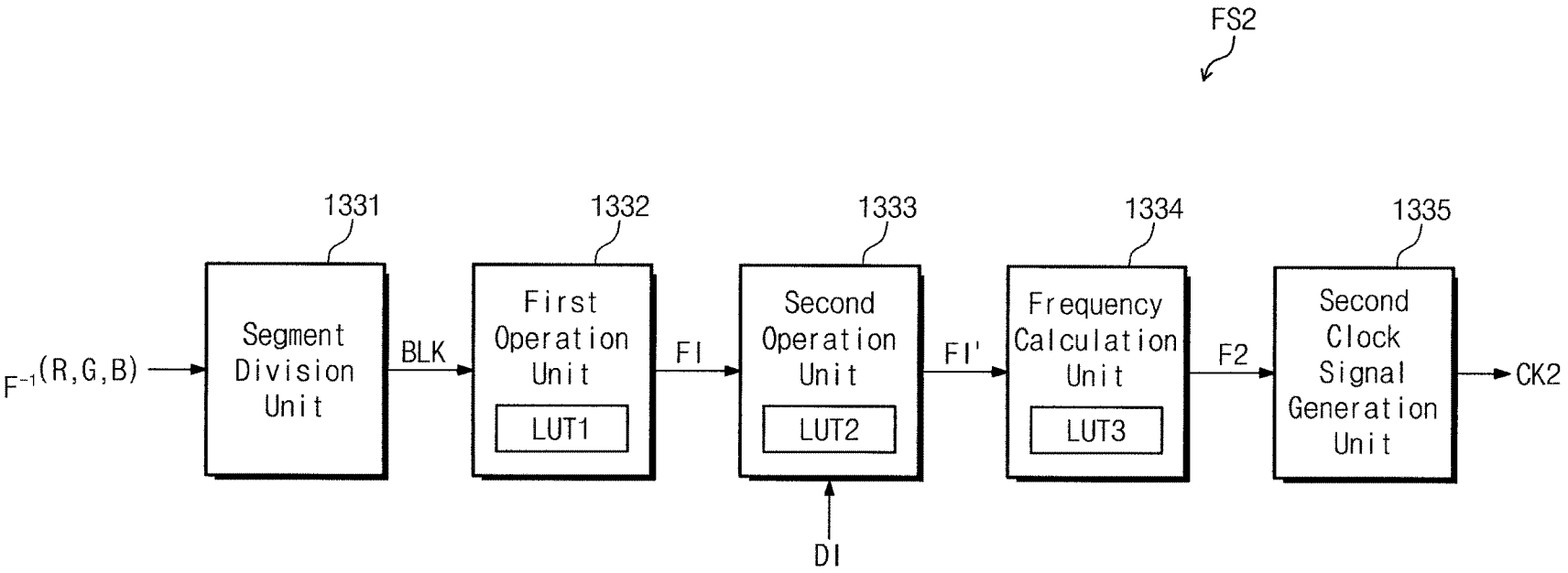
FIG. 3 is a block diagram of a second frequency selection unit of FIG. 2.
Figure 4:
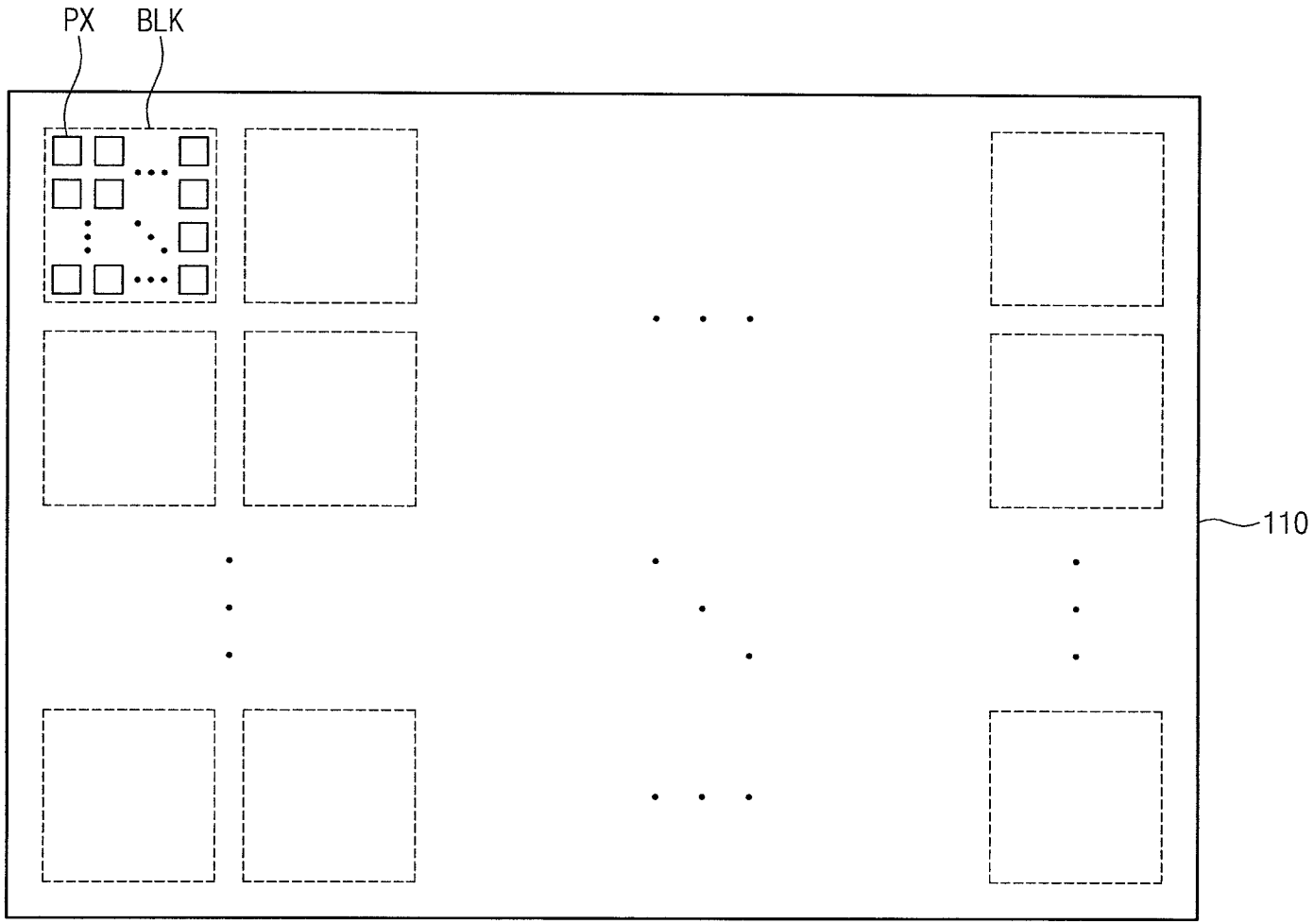
FIG. 4 is a view illustrating an operation of a segment division unit of FIG. 3.
Figure 5:
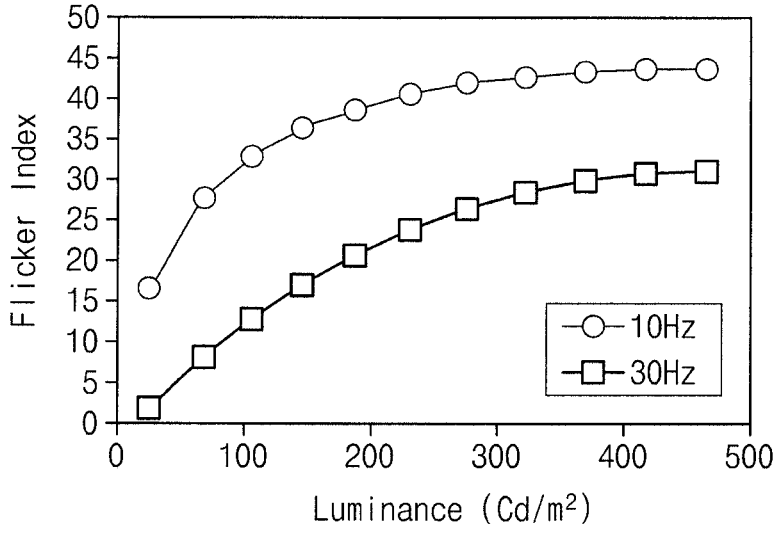
FIG. 5 is a view illustrating a flicker index according to luminance at a specific frequency.
Figure 6:
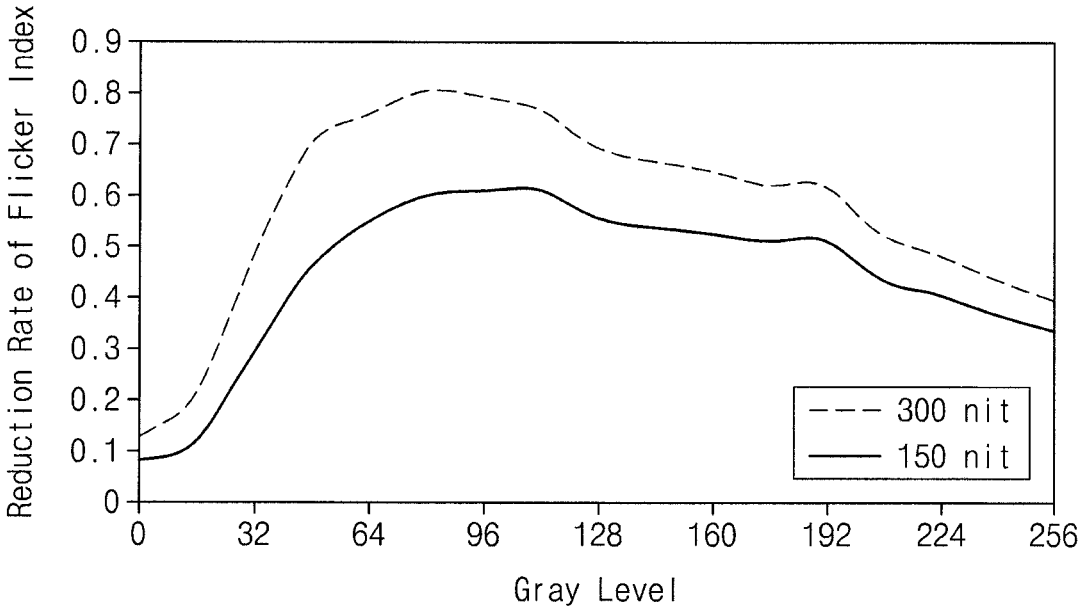
FIG. 6 is a view illustrating a reduction rate of a flicker index according to a dimming value at a specific frequency.

FIG. 3 is a block diagram of the second frequency selection unit of FIG. 2. FIG. 4 is a view illustrating an operation of a segment division unit (e.g., a segment divider) of FIG. 3. FIG. 5 is a view illustrating a flicker index according to luminance at a specific frequency. FIG. 6 is a view illustrating a reduction rate of the flicker index according to a dimming value at a specific frequency.

The specific frequencies shown in FIG. 5 are, for example, about 10 Hz and about 30 Hz. The specific frequency shown in FIG. 6 is, for example, about 30 Hz. When a maximum luminance of the backlight is about 400 nits, the reduction rate of the flicker index according to the dimming value with reference to 400 nits is illustrated in FIG. 6.

Referring to FIGS. 3 and 4, the second frequency selection unit FS2 includes a segment division unit (e.g., a segment divider) 1331, a first operation unit (e.g., a first operator) 1332, a second operation unit (e.g., a second operator) 1333, a frequency calculation unit (e.g., a frequency calculator) 1334, and a second clock signal generation unit (e.g., a second clock signal generator) 1335.

The segment division unit 1331 receives the image signals $F^{-1}$(R G, and B) of the previous frame from the frame memory 132. The segment division unit 1331 groups the image signals $F^{-}$(R, G, and B) of the previous frame into a plurality of segment blocks BLK.

In the case of a display panel having high resolution, the number of pixels that are used in the display panel may increase, and the size of each of the pixels may decrease. While the user may not recognize the flicker generated in one pixel, the flicker may be generated in more than a minimum number of pixels, so that the user may recognize the flicker. The segment blocks BLK includes the image signals corresponding to the minimum number of pixels by which the flicker is recognizable by the user.

The image signals $F^{-1}$(R, G, and B) of the previous frame are respectively displayed on the corresponding pixels PX from among the pixels PX of the display panel 110. Thus, as illustrated in FIG. 4, the segment division unit 1331 groups the image signals $F^{-1}$(R, G, and B) of the previous frame into the segment blocks BLK in consideration of positions of the pixels PX in which the image signals $F^{-1}$(R, G, and B) of the previous frame are displayed. The segment division unit 1331 provides the segment blocks BLK to the first operation unit 1332.

The first operation unit 1332 includes a first look-up table LUT1. The flicker indexes corresponding to gradation values (e.g., gray levels) according to the reference frequency are stored in the first look-up table LUT1.

The flicker index is a numerical value indicating a degree (e.g., probability or possibility) of user's recognizing the flicker depending on the gradation values (e.g., gray levels) based on various frequencies. The flicker index increases as the frequency becomes lower, and decreases as the frequency becomes greater. As the flicker index becomes greater, the possibility in which the user recognizes the flicker increases.

The flicker index may be the highest at a medium gradation (e.g., a medium gray level)_having a set or predetermined gradation value (e.g., a set or predetermined gray level). For example, the medium gradation may refer to about 64 gradations (e.g., gray level equal to or substantially equal to 64). The flicker index may decrease from the medium gradation to a high gradation (e.g., a high gray level). Also, the flicker index may decrease from the medium gradation to a low gradation (e.g., a low gray level).

The reference frequency may be set to a value (e.g., a minimum value) of the second frequency. For example, when the second frequency is less than about 60 Hz and greater than or equal to about 10 Hz, the reference frequency may be set to about 10 Hz. That is, the reference frequency may be set to a frequency having a highest flicker index. Thus, the flicker indexes corresponding to the gradation values of 0 to 256 with reference to 10 Hz may be stored in the first look-up table LUT1.

The first operation unit 1332 determines the flicker index of each of the segment blocks BLK by using the flicker indexes of the first look-up table LUT1. For example, the first operation unit 1332 determines the flicker index corresponding to the gradation value of each of the image signals of each of the segment blocks BLK by using the first look-up table LUT1. The first operation unit 1332 calculates a mean value of the flicker indexes of the image signals of each of the segment blocks BLK to determine the flicker index of each of the segment blocks BLK.

The first operation unit 1332 provides the flicker indexes F1 of the segment blocks BLK to the second operation unit 1333.

Referring to FIG. 5, the flicker index increases as the luminance increases, and the flicker index decreases as the luminance decreases. The flicker index of 10 Hz is greater than that of 30 Hz. That is, the flicker index increase as the frequency decreases. The backlight 170 may have a maximum luminance of about 400 Cd/m2.

Referring to FIG. 6, the backlight 170 has the luminance of about 400 nits when the dimming value is about 100%. When the dimming value is about 75%, the luminance of the backlight 170 is set to about 300 nits, and when the dimming value is about 37.5%, the luminance of the backlight 170 is set to about 150 nits. As the luminance of the backlight 170 becomes lower, the flicker index becomes lower. The dimming value may be defined as the dimming index.

When the dimming value is about 75% at about 128 gradations (e.g., gray level equal to or substantially equal to 128), the flicker index is reduced by about 0.7 times when compared to that when the dimming value is about 100%. When the dimming value is about 37.5% at about the 128 gradations, the flicker index is reduced by about 0.55 times when compared to that when the dimming value is 100%.

For example, in FIG. 6, it is assumed that the dimming value is at 100%, the second frequency is equal to or substantially equal to 30 Hz, and the flicker index is equal to or substantially equal to about 30 at the 128 gradations. When the dimming value is about 75% at the 128 gradations, the flicker index is reduced to about 21, which is a value obtained by multiplying 30 by 0.7. When the dimming value is about 37.5% at the 128 gradations, the flicker index is reduced to about 16.5, which is a value obtained by multiplying 30 by 0.55.

Referring to FIG. 3, the second operation unit 1333 includes a second look-up table LUT2. The second operation unit 1333 receives the dimming index DI of the backlight control signal BCS.

The reduction rate of the flicker indexes corresponding to gradation values (e.g., gray levels) according to each of the plurality of dimming indexes corresponding to the reference frequency are stored in the second look-up table LUT2. The reduction rate of the flicker index is set such that the flicker index becomes lower as the dimming indexes become lower.

The flicker indexes FI of the segment blocks BLK are values to which the dimming index DI of the backlight 170 is not applied. For example, the flicker indexes FI of the segment blocks BLK that is determined by the first operation unit 1332 correspond to the dimming index of 100%.

Since the backlight 170 is driven based on the dimming method, the flicker index may be determined when the reduction rate of the flicker index according to a reduction rate of luminance is applied to the flicker indexes FI. The second operation unit 1333 applies the reduction rate of the flicker index corresponding to the dimming index DI to the flicker indexes FI of the segment blocks BLK by using the second look-up table LUT2.

For example, the second operation unit 1333 determines the reduction rate of the flicker index corresponding to the dimming index DI by using the second look-up table LUT2. The second operation unit 1333 determines flicker indexes FI' to which the dimming index DI is applied, such that the flicker indexes FI of the segment blocks BLK is multiplied by the reduction rate of the flicker index corresponding to the dimming index DI.

The second operation unit 1333 provides the flicker indexes FI' of the segment blocks to which the dimming index is applied to the frequency calculation unit 1334.

The frequency calculation unit 1334 includes a third look-up table LUT3. The determined (e.g., optimized) second frequency values corresponding to various flicker indexes are stored in the third look-up table LUT3. The determined second frequency value stored in the third look-up table LUT3 refers to a frequency (e.g., a minimum frequency) at which the flicker may not be recognized.

As described above, the flicker index increase as the frequency becomes lower, and decrease as the frequency becomes greater. Thus, according to the flicker index, the frequency at which the flicker is not generated may be determined. For example, the frequency may be set to a value greater than a set or predetermined value, so that the flicker is not generated in the flicker index having a set or predetermined value. Frequencies (e.g., minimum frequencies) at which the flicker is not generated in the flicker indexes are stored in the third look-up table LUT3.

The frequency calculation unit 1334 determines the second frequency value F2 corresponding to the flicker index FI' having a highest value from among the flicker indexes FI' by using the third look-up table LUT3.

The frequency calculation unit 1334 provides the second frequency value F2 to the second clock signal generation unit 1335. The second clock signal generation unit 1335 outputs the second clock signal CK2 having the second frequency value F2. Thus, when the display panel 110 displays the still image, the display panel 110 may be driven at the second frequency.

The flicker index decrease as the luminance becomes lower, and the display panel may be driven at the low frequency as the flicker index becomes lower. Since the dimming index is not considered when the second operation unit 1333 is not used, the flicker indexes FI are determined to correspond to the dimming index of 100%. However, since the second operation unit 1333 determines the flicker indexes FI' in consideration of the dimming index, the second frequency may be set to a frequency lower than that of the second frequency that is set when the dimming index is set to 100%. As the frequency becomes lower, power consumption decreases.

The flicker indexes FI of the segment blocks BLK are determined according to the reference frequency having a highest flicker index, and the second frequency is determined according to the flicker index having a greatest (e.g., highest) value from among the flicker indexes FI' of the segment blocks BLK. Thus, the possibility in which the user recognizes the flicker decreases (e.g., is the lowest).

As a result, the display apparatus 100 according to an embodiment of the present invention may determine the desired driving frequency for displaying the still image on the basis of the flicker index FI and the dimming index DI to prevent or reduce the flicker phenomenon, and to reduce the power consumption.

Figure 7:
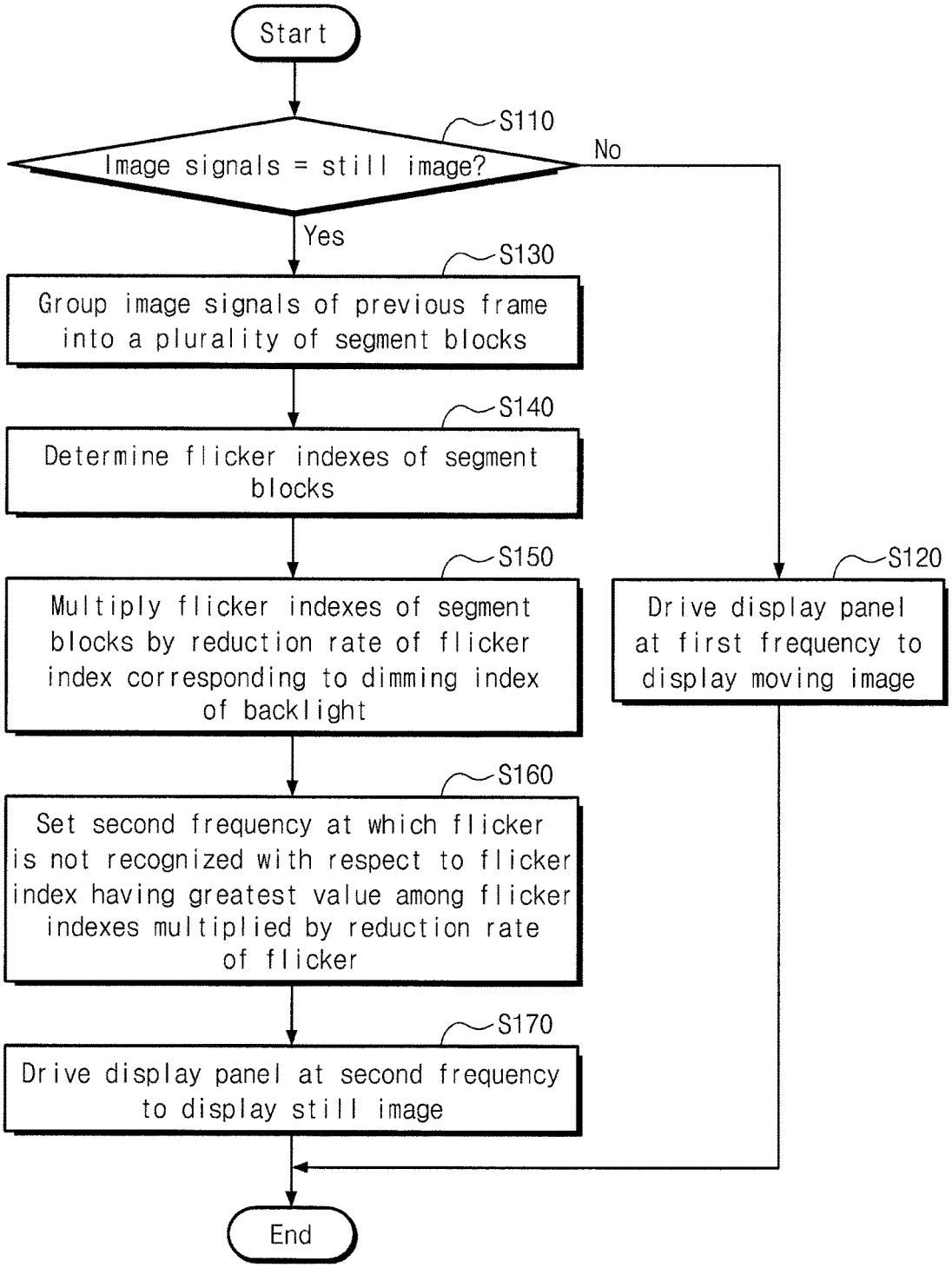
FIG. 7 is a flowchart illustrating a method for driving the display apparatus according to an embodiment of the present invention.

FIG. 7 is a flowchart illustrating a method for driving the display apparatus according to an embodiment of the present invention.

Referring to FIG. 7, during an operation S110, it is determined whether the image signals R, G, and B are for still images or not. This operation may be performed in the system board 120.

When the image signals R, G, and B are not for the still images (e.g., but for the moving images), the display panel 110 is driven at the first frequency to display the moving image during an operation S120. For example, the image signals that are synchronized with the first clock signal CK1 having the first frequency to display the moving image may be provided to the display panel 110 to be displayed.

When the image signals R, G, and B are for the still images, during an operation S130, the segment division unit 1331 groups the image signals $F^{-1}$(R, G, and B) of the previous frame into a plurality of segment blocks BLK.

During an operation S140, the first operation unit 1332 determines the flicker indexes FI of the segment blocks BLK. For example, the flicker index corresponding to the gradation value (e.g., the gray level) of each of the image signals of each of the segment blocks BLK is determined by using the first look-up table LUT1. The flicker index FI of each of the segment blocks BLK is determined by calculating the mean value of the flicker indexes of the image signals of each of the segment blocks BLK.

During an operation S150, the flicker indexes FI of the segment blocks BLK is multiplied by the reduction rate of the flicker corresponding to the dimming index DI of the backlight 170 by the second operation unit 1333. For example, the reduction rate of the flicker index corresponding to the dimming index DI is determined by using the second look-up table LUT2. The flicker indexes FI of the segment blocks BLK is multiplied by the reduction rate of the flicker index corresponding to the dimming index DI, and then a resultant value is outputted.

During an operation S160, the second frequency at which the flicker may not be recognized according to the flicker index having the greatest value from among the flicker indexes FI' applied by the reduction rate of the flicker index is set.

For example, the second frequency value F2 corresponding to the flicker index FI' having the greatest value from among the flicker indexes FI' of the segment blocks BLK multiplied by the reduction rate of the flicker index is determined by using the third look-up table LUT3. The second clock signal CK2 having the second frequency value F2 is generated, and the image signals synchronized with the second clock signal CK2 to display the still image are provided to the display panel 110.

During an operation S170, the display panel 110 is driven at the second frequency to display the still image.

Therefore, the method for driving the display apparatus 100 according to one or more embodiments of the present invention may determine the desired driving frequency for displaying the still image based on the flicker index FI and the dimming index DI, thereby preventing or reducing the flicker phenomenon, and reducing the power consumption.

According to one or more embodiments of the present invention, a display apparatus and a method for driving the same may determine the desired driving frequency for displaying the still image based on the flicker index and the dimming index of the backlight to prevent or reduce the flicker phenomenon, and to reduce the power consumption.

In the drawings, the relative sizes of elements, layers, and regions may be exaggerated for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Although exemplary embodiments of the present invention have been described, it will be understood that the present invention is not limited to these exemplary embodiments, and that various changes and modifications may be made as understood by those of ordinary skilled in the art within the spirit and scope of the present invention as defined in the following claims, and their equivalents.

What is claimed is:

1. A display apparatus comprising:

a backlight configured to generate light;

a display panel configured to display an image by utilizing the light;

a driving part configured to provide image signals corresponding to the image to the display panel; and a timing controller configured to drive the backlight, to drive the driving part at a first frequency when the image is a moving image, and to drive the driving part at a second frequency lower than the first frequency when the image is a still image, wherein the timing controller is configured to set the second frequency based on a value obtained by applying a reduction rate of a flicker index corresponding to a dimming index of the backlight to a flicker index of image signals of a previous frame, and wherein the timing controller comprises:

a frame memory configured to store the image signals; and a data outputter configured to synchronize the image signals of the previous frame that is provided from the frame memory with a second clock signal having the second frequency, and to output the synchronized image signals to the driving part, when the image of a current frame is the still image.

2. The display apparatus of claim 1, wherein the timing controller comprises:

a first frequency selector configured to output a first clock signal having the first frequency;

a second frequency selector configured to output the second clock signal having the second frequency; and the data outputter configured to receive the image signals, to synchronize the image signals with the first clock signal, and to output the synchronized image signals to the driving part when the image of the current frame is the moving image.

3. The display apparatus of claim 2, wherein the second frequency selector is configured to output the second clock signal having the second frequency based on a value obtained by applying the reduction rate of the flicker index to flicker indexes of the image signals of the previous frame.

4. The display apparatus of claim 2, wherein the second frequency selector comprises:

a segment divider configured to group the image signals of the previous frame that are provided from the frame memory into a plurality of segment blocks;

a first operator configured to calculate flicker indexes of the segment blocks;

a second operator configured to multiply the flicker indexes of the segment blocks by the reduction rate of the flicker index;

a frequency calculator configured to determine a second frequency value corresponding to a flicker index having a largest value from among the flicker indexes of the segment blocks multiplied by the reduction rate of the flicker index; and a second clock signal generator configured to generate the second clock signal having the second frequency value.

5. The display apparatus of claim 4, wherein each of the segment blocks comprises image signals corresponding to a minimum number of pixels by which a flicker is recognizable by a user.

6. The display apparatus of claim 4, wherein the first operator comprises a first look-up table configured to store flicker indexes corresponding to gray levels according to a reference frequency.

7. The display apparatus of claim 6, wherein the first operator is configured to determine the flicker indexes respectively corresponding to the gray levels of the image signals of each of the segment blocks by utilizing the first look-up table, and to calculate a mean value of the flicker indexes of the image signals of each of the segment blocks to output the mean value as the flicker index of each of the segment blocks.

8. The display apparatus of claim 6, wherein the reference frequency is a minimum value of the second frequency.

9. The display apparatus of claim 8, wherein the second frequency is less than about 60 Hz and greater than about 10 Hz.

10. The display apparatus of claim 4, wherein the second operator comprises a second look-up table configured to store the reduction rate of the flicker indexes corresponding to gray levels according to each of a plurality of dimming indexes corresponding to a reference frequency that is a minimum value of the second frequency.

11. The display apparatus of claim 10, wherein the second operator is configured to determine the reduction rate of the flicker index by utilizing the second look-up table, and to multiply the flicker indexes of the segment blocks by the reduction rate of the flicker index to output a resultant value.

12. The display apparatus of claim 4, wherein the frequency calculator comprises a third look-up table configured to store the second frequency values as a minimum frequency at which the flicker is not recognizable and corresponding to various flicker indexes.

13. The display apparatus of claim 12, wherein the frequency calculator is configured to determine the second frequency value corresponding to the flicker index having the largest value among the flicker indexes of the segment blocks multiplied by the reduction rate of the flicker index by utilizing the third look-up table.

14. A method for driving a display apparatus, the method comprising:

determining whether image signals are for a still image or for a moving image;

driving a display panel at a first frequency to display the moving image when the image signals are for the moving image;

grouping image signals of a previous frame into a plurality of segment blocks when the image signals are for the still image;

calculating flicker indexes of the segment blocks;

multiplying the flicker indexes of the segment blocks by a reduction rate of a flicker index corresponding to a dimming index of a backlight;

setting a second frequency at which a flicker is not recognizable based on a flicker index having a largest value from among the flicker indexes multiplied by the reduction rate of the flicker index; and driving the display panel at the second frequency to display the still image.

15. The method of claim 14, wherein the driving of the display panel at the first frequency comprises providing the image signals synchronized with a first clock signal having the first frequency to the display panel to display the moving image.

16. The method of claim 14, wherein each of the segment blocks comprises image signals corresponding to a minimum number of pixels by which the flicker is recognizable by a user.

17. The method of claim 14, wherein the calculating of the flicker indexes comprises:

determining flicker indexes respectively corresponding to gray levels of the image signals of each of the segment blocks by utilizing a first look-up table storing flicker indexes according to the gray levels corresponding to a reference frequency; and calculating a mean value of the flicker indexes of the image signals of each of the segment blocks to output the mean value as the flicker index of each of the segment blocks.

18. The method of claim 17, wherein the reference frequency is a minimum value of the second frequency, and the second frequency is less than about 60 Hz and greater than about 10 Hz.

19. The method of claim 17, wherein the multiplying of the reduction rate of the flicker index comprises:

determining the reduction rate of the flicker index by utilizing a second look-up table storing the reduction rate of the flicker indexes corresponding to gray levels according to each of a plurality of dimming indexes corresponding to the reference frequency; and multiplying the flicker indexes of the segment blocks by the reduction rate of the flicker index to output a resultant value.

20. The method of claim 14, wherein the setting of the second frequency comprises:

determining a second frequency value corresponding to the flicker index having a largest value from among the flicker indexes of the segment blocks multiplied by the reduction rate of the flicker index by utilizing a third look-up table storing second frequency values as a minimum frequency at which the flicker is not recognizable and corresponding to various flicker indexes;

generating a second clock signal having the determined second frequency value; and providing the display panel with image signals synchronized with the second clock signal to display the still image.

21. A display apparatus comprising:

a backlight configured to generate light;

a display panel configured to display an image by utilizing the light;

a driving part configured to provide image signals corresponding to the image to the display panel; and a timing controller configured to drive the backlight, to drive the driving part at a first frequency when the image is a moving image, and to drive the driving part at a second frequency lower than the first frequency when the image is a still image, wherein the timing controller is configured to set the second frequency based on a value obtained by applying a reduction rate of a flicker index corresponding to a dimming index of the backlight to a flicker index of image signals of a previous frame, and wherein the timing controller is further configured to group image signals of the previous frame into a plurality of segment blocks, to calculate flicker indexes of the segment blocks, and to set the second frequency based on a flicker index having a largest value from among the flicker indexes of the segment blocks multiplied by the reduction rate of the flicker index.

* * * * *